US009816538B1

(12) United States Patent
Wagner et al.

(10) Patent No.: US 9,816,538 B1
(45) Date of Patent: Nov. 14, 2017

(54) TENSIONER CYLINDER WITH INTERNAL GAS BLADDER IN HIGH PRESSURE CHAMBER

(71) Applicant: Vetco Gray Inc., Houston, TX (US)

(72) Inventors: Robert James Wagner, Houston, TX (US); Benjamin James Kubichek, Houston, TX (US); Daniel Louis Havelka, Houston, TX (US)

(73) Assignee: VETCO GRAY INC., Houston, TX (US)

( * ) Notice: Subject to any disclaimer, the term of this patent is extended or adjusted under 35 U.S.C. 154(b) by 0 days.

(21) Appl. No.: 15/253,451

(22) Filed: Aug. 31, 2016

(51) Int. Cl.

| | |
|---|---|
| ***E21B 17/01*** | (2006.01) |
| ***F15B 15/02*** | (2006.01) |
| ***E21B 19/00*** | (2006.01) |
| ***F15B 15/14*** | (2006.01) |

(52) U.S. Cl.
CPC ..... *F15B 15/02* (2013.01); *E21B 17/01* (2013.01); *E21B 19/006* (2013.01); *F15B 15/1428* (2013.01); *F15B 15/1452* (2013.01); *F15B 15/1457* (2013.01); *F15B 2215/30* (2013.01)

(58) Field of Classification Search
CPC ..... E21B 17/01; E21B 19/006; F15B 15/02; F15B 15/1428; F15B 15/1452; F15B 15/1457
See application file for complete search history.

(56) References Cited

U.S. PATENT DOCUMENTS 4,815,574 A * 3/1989 Taylor ..... F16F 9/361 188/269
4,883,387 A * 11/1989 Myers ..... E21B 19/006 166/367
5,363,920 A * 11/1994 Alexander ..... B63B 21/50 166/350
5,366,324 A * 11/1994 Arlt ..... E21B 19/006 166/367
5,992,584 A * 11/1999 Moody ..... F16F 9/10 188/297

(Continued)

FOREIGN PATENT DOCUMENTS

GB 2109036 5/1983

*Primary Examiner* — Matthew R Buck
(74) *Attorney, Agent, or Firm* — Hogan Lovells US LLP

(57) ABSTRACT

A hydraulic cylinder enclosing a cavity, the cylinder containing a thru hole, an inner cylinder surface, and a longitudinal axis, and a piston within the cavity and movable relative to the cylinder in parallel to the longitudinal axis between a first and second positions. The piston includes a rod extending through the thru hole, the piston attached to the rod and in sealed engagement with the inner cylinder surface, and dividing the cavity into low and high pressure cavities, and each of the low and high pressure cavities containing a hydraulic fluid. The hydraulic cylinder further including a flexible bladder within the high pressure cavity containing a gas and preventing the gas from mixing with hydraulic fluid in the high pressure cavity. The flexible bladder is attached to an end of the cylinder, and is expandable within the high pressure cavity so that when the piston is in the first position, the flexible bladder and the gas are compressed, and as the piston moves toward the second position, the flexible bladder and the gas fill at least a portion of the high pressure cavity.

20 Claims, 3 Drawing Sheets

(56) References Cited

U.S. PATENT DOCUMENTS

| | | | | |
|---|---|---|---|---|
| 6,345,707 | B1 * | 2/2002 | Klembczyk | F16F 9/003 188/298 |
| 6,968,900 | B2 * | 11/2005 | Williams | E21B 19/09 166/355 |
| 7,112,011 | B2 | 9/2006 | McCarty et al. | |
| 7,131,496 | B2 * | 11/2006 | Williams | E21B 19/09 166/355 |
| 7,131,922 | B2 | 11/2006 | Williams et al. | |
| 7,231,981 | B2 * | 6/2007 | Moe | E21B 19/09 166/352 |
| 7,819,195 | B2 | 10/2010 | Ellis | |
| 8,789,604 | B2 | 7/2014 | Phadke et al. | |
| 9,441,426 | B2 * | 9/2016 | Gutierrez-Lemini | E21B 17/085 |
| 2014/0202327 | A1 * | 7/2014 | Ellis | E21B 19/006 92/143 |
| 2016/0061233 | A1 * | 3/2016 | Staab | F15B 15/1447 60/413 |

* cited by examiner

TENSIONER CYLINDER WITH INTERNAL GAS BLADDER IN HIGH PRESSURE CHAMBER

BACKGROUND

1. Field of Invention

Embodiments disclosed herein relate generally to equipment for use in oil field applications. In particular, embodiments disclosed herein relate to tensioner systems for tensioning of marine risers.

2. Related Technology

Risers are used for offshore oil and gas wells to connect the subsea wellhead to the topside equipment on a floating production platform. Typically, a riser system is employed to provide a conduit from a floating vessel at the water surface where the blowout preventer (BOP) stack or production tree are located down to the wellhead at the sea floor.

Tensioners are employed at the platform to apply tension to the risers. A tensioning system maintains a variable tension to the riser string, thereby alleviating the potential for compression, which can lead to buckling or failure of the risers. Another purpose of a tensioner is to serve as a motion compensator. A tensioner that is incorporated into a riser string can compensate for vessel motion induced by wave action and heave.

A typical tensioner comprises a set of hydraulic cylinders with telescoping piston and cylinder arrangements supplied with gas pressure from external or integral accumulator chambers. Vessel motion relative to a fixed point, possibly due to waves or currents, causes the piston and cylinder to extend and retract.

SUMMARY

One embodiment of the present technology provides a hydraulic cylinder enclosing a cavity, the hydraulic cylinder containing a thru hole, an inner cylinder surface, and a longitudinal axis. The hydraulic cylinder includes a piston disposed within the cavity and movable relative to the hydraulic cylinder in a direction parallel to the longitudinal axis between a first compressed position and a second extended position. The piston includes a rod extending through the thru hole of the hydraulic cylinder, and is attached to the rod and in sealed engagement with the inner cylinder surface. The piston dividing the cavity in the hydraulic cylinder into a low pressure cavity, and a high pressure cavity containing the rod, each of the low and high pressure cavities containing a hydraulic fluid. In addition, the hydraulic cylinder includes a flexible bladder disposed within the high pressure cavity for containing a gas and preventing the gas from mixing with hydraulic fluid in the high pressure cavity, the flexible bladder attached to an end of the hydraulic cylinder, and expandable within the high pressure cavity so that when the piston is in the first compressed position, the flexible bladder and the gas are compressed, and as the piston moves toward the second extended position, the flexible bladder and the gas fill at least a portion of the high pressure cavity.

Another embodiment of the present technology provides a flexible bladder for use in a hydraulic cylinder, the hydraulic cylinder including a cylinder barrel enclosing a cavity, and a piston disposed within the cavity, movable relative to the cylinder barrel, and dividing the cavity into a low pressure cavity and a high pressure cavity, each of the low and high pressure cavities containing a hydraulic fluid. The flexible bladder includes a protective film positioned in the high pressure cavity, enclosing a gas, and preventing the gas from mixing with the hydraulic fluid in the high pressure cavity.

Yet another embodiment of the present technology provides a method of tensioning a marine riser using a hydraulic cylinder, the hydraulic cylinder including a cylinder barrel enclosing a cavity, and a piston disposed within the cavity, movable relative to the cylinder barrel, and dividing the cavity into a low pressure cavity and a high pressure cavity. Each of the low and high pressure cavities contain hydraulic fluid, and the piston is attached to a rod extending outside the cylinder barrel. The hydraulic cylinder further includes a flexible bladder positioned in the high pressure cavity, enclosing a gas, and preventing the gas from mixing with the hydraulic fluid in the high pressure cavity. The method includes attaching the rod to a marine riser, and damping movement of the marine riser by compressing the gas within the flexible bladder as a tension force is applied to the piston rod so that the piston compresses the flexible bladder.

BRIEF DESCRIPTION OF THE DRAWINGS

The present technology will be better understood on reading the following detailed description of nonlimiting embodiments thereof, and on examining the accompanying drawings, in which.

DETAILED DESCRIPTION OF THE DISCLOSURE

Figure 1:
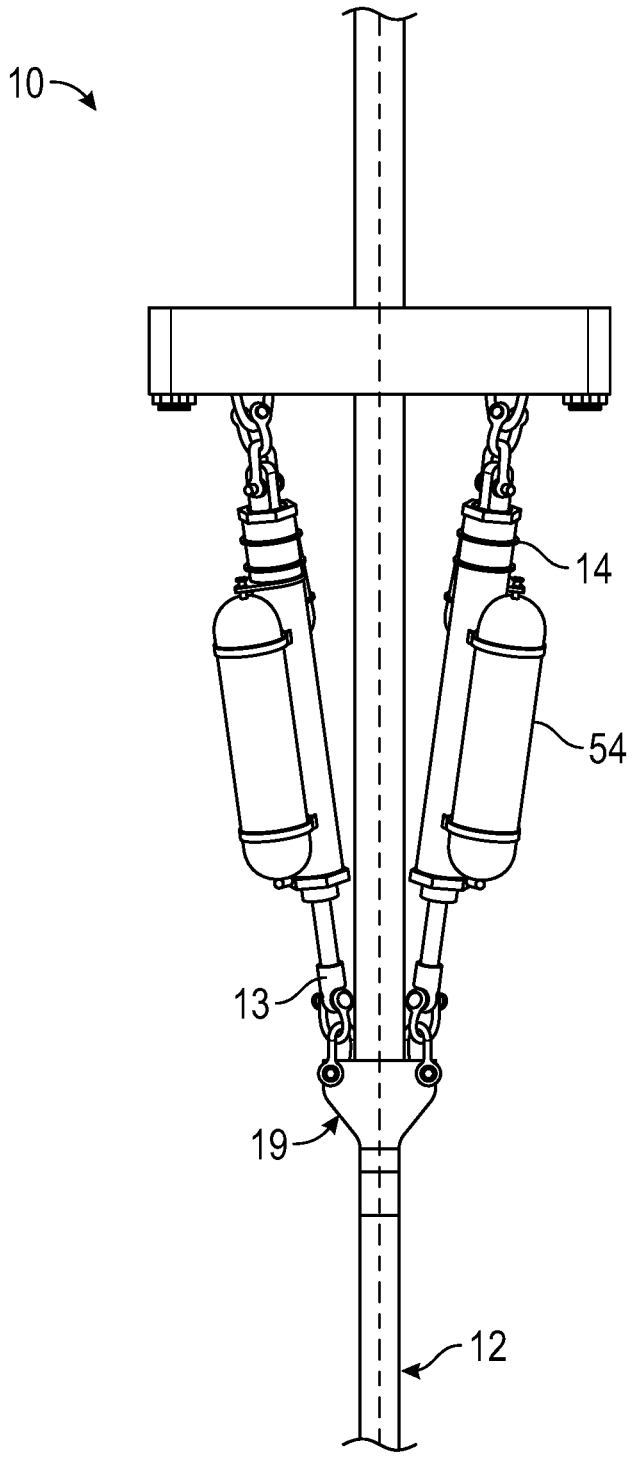
FIG. 1 shows a side schematic view of a tensioner system, including a subsea riser and hydraulic cylinders/accumulators in accordance with an embodiment of the present technology.

The foregoing aspects, features, and advantages of the present technology will be further appreciated when considered with reference to the following description of preferred embodiments and accompanying drawings, wherein like reference numerals represent like elements. The following is directed to various exemplary embodiments of the disclosure. The embodiments disclosed should not be interpreted, or otherwise used, as limiting the scope of the disclosure, including the claims. In addition, those having ordinary skill in the art will appreciate that the following description has broad application, and the discussion of any embodiment is meant only to be exemplary of that embodiment, and not intended to suggest that the scope of the disclosure, including the claims, is limited to that embodiment.

FIG. 1 shows a side schematic view of a riser tensioner system 10, including a marine riser 12 and hydraulic cylinders 14 with external accumulator tanks 54 in accordance with an embodiment of the present technology. Typically, the marine riser 12 is a connection conduit between the floating vessel at the water surface to the blowout preventer (BOP) stack, which is connected to the wellhead at the sea floor. The marine riser 12 can include, but is not limited to, an attached riser, a pull tube riser, a steel catenary riser, a top-tensioned riser, a riser tower, and a production riser or a drilling riser. In normal operation, the riser tensioner system 10 pulls upward on the marine riser 12 to maintain tension therein.

The hydraulic cylinder 14 is integrated into the riser tensioner system 10, which may be utilized in drilling, production, and injection systems. The hydraulic cylinder 14, which may be a bank of hydraulic cylinders 14, of the present technology manages the differential movements in between the marine riser 12 and the floating vessel, and enables compensation for floating vessel movements. The hydraulic cylinders 14, for example, can serve as an energy storage device by storing potential energy, can accommodate fluid expansion, and provide damping for pressure transients. The hydraulic cylinders 14, for example, can provide a somewhat steady load to moving objects, such as marine risers 12, in order to maintain some nominal position, and can serve as dampers to reduce load spikes or peak stresses to extend the life of the riser system. Moreover, the hydraulic cylinders 14 can provide the force necessary to maintain the marine riser 12 within a range of preselected operation tension. In effect, the hydraulic cylinders 14, can serve as gas springs, to provide a controlled riser tension range over the stroke range of the marine riser 12.

Figure 2B:
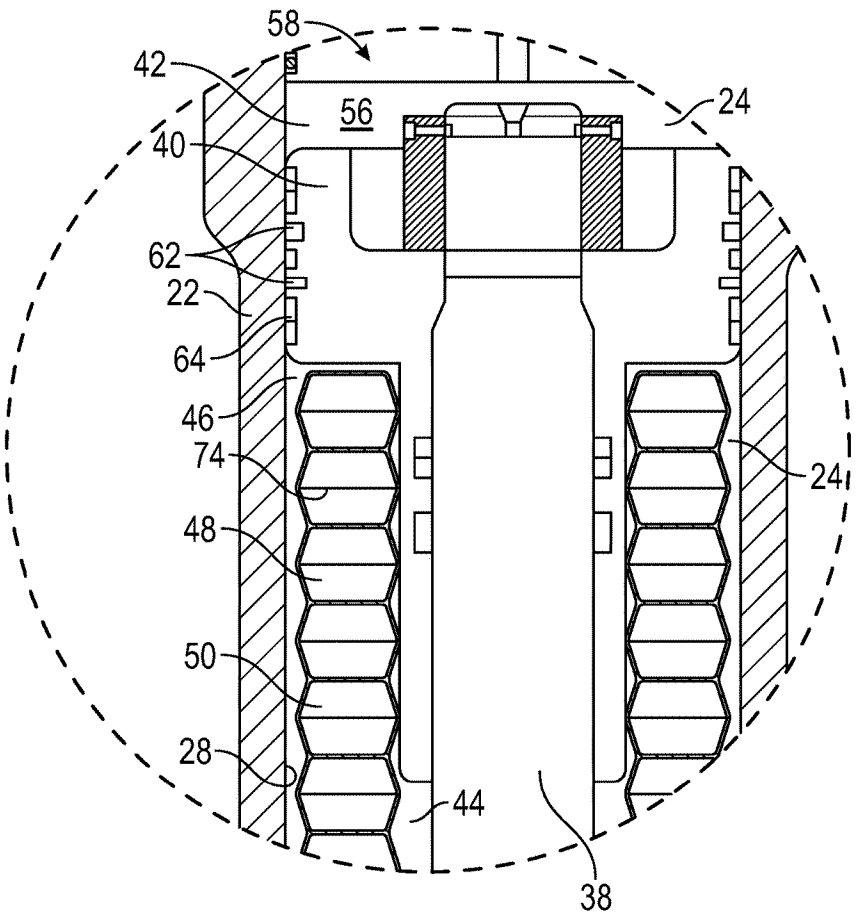
FIG. 2B shows an enlarged cross-sectional view of a portion of the hydraulic cylinder shown in FIG. 2A.
Figure 2A:
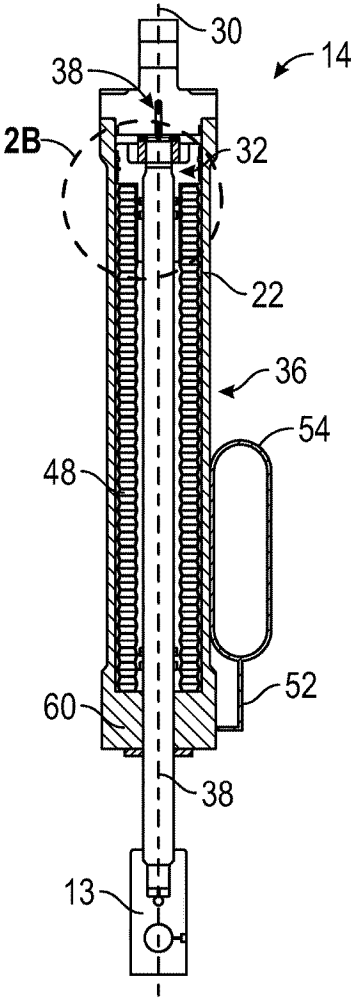
FIG. 2A shows a side cross-sectional view of a hydraulic cylinder at up stroke according to an embodiment of the present technology.

FIG. 2A shows a side cross-sectional view of a hydraulic cylinder 14 at up stroke, including a flexible bladder 48. Certain features of the hydraulic cylinder 14 further include a cylinder barrel 22, and a piston 32 attached to a rod 38. The cylinder barrel 22 is capped on one end by an end cap 58 and on the other end by a cylinder head 60. The rod 38 passes through and is in sealed engagement with a hole in the cylinder head 60, which is centered about the hydraulic cylinder axis 30. The flexible bladder 48 is attached to the cylinder head 60. The flexible bladder 48 may be single flexible bladder 48 substantially circumventing the rod 38, or there may be multiple flexible bladders 48 placed circumferentially around the rod 38.

As further shown in FIG. 2B, the flexible bladder 48 for use in a hydraulic cylinder 14 can incorporate a plurality of gas bellow expansion joints 74. The plurality of gas bellow expansion joints 74 is attached to the cylinder head 60 (as shown in FIG. 2A) and interconnected to form a spring mechanism that is movable relative to the hydraulic cylinder 14 in direction parallel to the longitudinal axis 30 of the hydraulic cylinder 14. The flexible bladder 48 encloses a compressible gas 50, and prevents the gas 50 from mixing with a hydraulic fluid 46 disposed in the hydraulic cylinder 14. The plurality of gas bellow expansion joints 74 allow compression and expansion of the flexible bladder 48 in sync with the cylinder 14 and therefore the stroke of the marine riser 12 (shown in FIG. 1).

Figure 3:
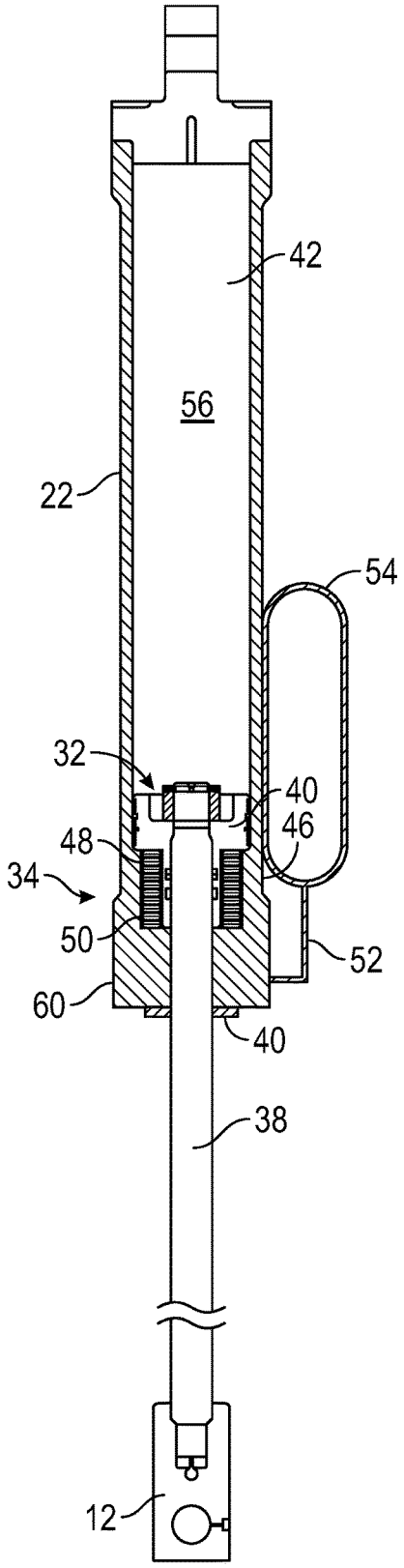
FIG. 3 shows a cross-sectional view of a hydraulic cylinder at down stroke according to an embodiment of the present technology.

Embodiments of the hydraulic cylinder 14 provide a tensile force to the marine riser 12 through the use of the gas 50, which may be a high pressure gas, contained in the flexible bladder 48. For example, when the hydraulic cylinder 14 strokes into a charged condition, which may be the first compressed position, as is shown in FIG. 3, the piston 32 moves toward a cylinder head 60 of the cylinder barrel 22 so as to compress the gas 50 within the flexible bladder 48 so that the pressure of the gas 50 increases. On the other hand, when the piston 32 strokes into a discharged position, which may be the second extended position 36, as is shown in FIGS. 2A and 2B, the gas 50 within the flexible bladder 48 expands, and the pressure of the gas 50 within the flexible bladder 48 decreases.

FIG. 2B shows an enlarged cross-sectional view of the flexible bladder 48 within a hydraulic cylinder 14 at up stroke, taken as a close-up view from FIG. 2A. The hydraulic cylinder 14 includes the features discussed above with respect to FIG. 2A, as well as a cylinder barrel 22 with a cavity 24, the cavity 24 including a low pressure cavity 42 containing a low pressure hydraulic fluid/gas mixture 56 and a high pressure cavity 44 containing the hydraulic fluid 46, and an inner barrel surface 28. The high pressure cavity 44 is disposed within the cylinder barrel 22 and is defined by the inner barrel surface 28, which faces inwardly towards the rod 38. A first end of the cylinder barrel 22 includes an end cap 58. A second end of the cylinder barrel 22 includes the cylinder head 60, which has an opening therethrough centered about the longitudinal axis 30 of the hydraulic cylinder 14. Thus, the working volume of the hydraulic cylinder 14 is positioned between the end cap 58 and the cylinder head 60.

The piston 32 may be housed within the cylinder barrel 22, and is arranged to slidingly and sealingly engage the inner barrel surface 28. The piston 32 separates the low pressure cavity 42 from the high pressure cavity 44, and strokes in sync with the stroke cycle of the marine riser 12 towards the cylinder head 60 by translating within the cavity 24 in a direction parallel to the longitudinal axis 30 of the hydraulic cylinder 14. Because both the low pressure cavity 42 and the high pressure cavity 44 contain fluid, dynamic seals 62 positioned between the piston 32 and the cylinder barrel 22 are lubricated from both sides. In practice, the marine riser 12 is attached to a tension ring 19 (shown in FIG. 1), which is linked to a rod end interface 13 of the hydraulic cylinders 14. The rod end interface 13 is in turn attached to the rod 38, which extends from the opening in the second cylinder head 60. As the rig heaves, the marine riser 12 is kept in tension by the tensioner system 10, via a load path that starts with the compressed gas 50 in the second cavity 44 that transfers to the piston 32, which applies force to rod 38, then rod end interface 13, then the tension ring 19, and finally the marine riser 12. When the rig heaves downwards, the marine riser 12 strokes upwards with respect to the rig, causing the hydraulic cylinder 14 to stroke upwards. This action increases the gas 50 volume in the second chamber 44, which in turn decreases the gas 50 pressure and the applied load on the piston 32, thereby resulting in less tension applied to the marine riser 12.

As shown in FIG. 2A, the rod 38 may be attached to the piston 32 and disposed within the cylinder barrel 22. During the stroke of the marine riser 12, the rod 38 is slidably carried within the cavity 24 and extends through the opening in the cylinder head 60. The rod 38 is positioned to apply tension to a marine riser 12 in sync with the stroke cycle of the marine riser 12 by translating within the cavity 24, as described above. Thus, during normal operation, the rod 38 may move relative to the opening in the cylinder head 60, or within the cavity 24 in response to ocean currents and resulting vessel motion.

Under normal operation, the hydraulic cylinder 14 holds the hydraulic fluid 46 within the high pressure cavity 44. The gas 50, which can include, for example, but is not limited to, nitrogen or compressed air, is contained within the flexible bladder 48, which is also positioned within the high pressure cavity 44. Thus, in the high pressure cavity 44, the hydraulic fluid 46 is separated from the gas 50 by the flexible bladder 48. The hydraulic fluid 46, which may be nearly incompressible, provides a relatively quick response to the power demanded by the stroke of the marine riser 12. The gas 50, on the other hand, can be compressed to a high pressure and to low volumes, such that, for example, the gas 50 can store and release potential energy upon demand. Thus, particularly when in a compressed state, as shown in FIG. 3, the gas 50 may exert more pressure against the piston 32 than when in an expanded state, as shown in FIG. 2A, which may in turn exert more tensile force on the rod 38, the rod end interface 13, the tension ring 19, and the marine riser 12. The pressure of the gas 50 within the flexible bladder 48 is substantially equal to the pressure of the hydraulic fluid 46 outside the flexible bladder 48 in the high pressure cavity 44.

As further shown in FIG. 2B, another function of the high pressure cavity 44 is to provide hydraulic fluid 46 to wet one or more dynamic seals 62 and wear bands 64, for proper long-term functioning of the hydraulic cylinder 14. For example, as described above, piston 32 may carry the one or more dynamic seals 62 such that the hydraulic fluid 46 lubricates the dynamic seals 62 and wear bands 64. Thus, for example, the hydraulic fluid 46 and/or the low pressure fluid 56 may lubricate one or more of each of the sealing interfaces.

Referring now to FIG. 3, there is shown a cross-sectional view of a hydraulic cylinder 14 at down stroke with the compressed flexible bladder 48. As discussed above in reference to FIGS. 2A and 2B, the flexible bladder 48 contains the gas 50, which expands and compresses in sync with the stroke cycle of the marine riser 12. The flexible bladder 48, which may be composed of an elastomeric material, may be substantially confined within the high pressure cavity 44.

In certain embodiments in accordance with the present technology, as shown in FIGS. 2A and 3, the hydraulic cylinder 14 may include a gas line 52 extending from the flexible bladder 48, passing through the cylinder head 60 and out into a separate high pressure accumulator tank 54, which may be located external to the cylinder barrel 22. In some embodiments, the hydraulic cylinder may include one or more high pressure accumulator tank 54. The gas line 52 provides a fluid communication path between the flexible bladder 48 and the high pressure accumulator tank 54 for the gas 50. The high pressure accumulator tank 54 may serve as an external storage device for the gas 50 in order to reduce the pressure of the gas 50 and therefore applied tension load at full down stroke. During the up stroke of the marine riser 12, when the flexible bladder 48 is substantially expanded (e.g., as shown in FIGS. 2A and 2B) and substantially filled, the gas 50 may exit the high pressure accumulator tank 54 and move into the flexible bladder 48. The high pressure accumulator tank 54 may also be varied in size in order to reduce or increase the percent change in applied tension as a function of marine riser 12 stroke, which is defined as the tensioner system's stiffness. A larger high pressure accumulator tank 54 may be used to decrease the stiffness of the tensioner 10. A smaller high pressure accumulator tank 54 may be used to increase the stiffness of the tensioner 10.

In certain embodiments, the present technology provides a method for tensioning a marine riser 12 using a hydraulic cylinder 14 by attaching the rod 38 and the rod end interface 13 to the tension ring 19 and the marine riser 12, and damping movement of the marine riser 12 by compressing the gas 50 within the flexible bladder 48 as a tension force is applied to the rod 38 by the marine riser 12 so that the piston 32 compresses the flexible bladder 48. In the method, the cylinder barrel 22 encloses the cavity 24, and the piston 32 is disposed within the cavity 24 and movable relative to the cylinder barrel 22. The piston 32 divides the cavity 24 into the low pressure cavity 42 and the high pressure cavity 44, such that each of the low and high pressure cavities 42, 44 contains hydraulic fluid. The rod 38 extends outside the cylinder barrel 22 through the opening in the cylinder head 60. In the method for tensioning the marine riser 12, the hydraulic cylinder 14 further includes the flexible bladder 48 positioned in the high pressure cavity 44, enclosing the gas 50, and preventing the gas 50 from mixing with the hydraulic fluid 46 in the high pressure cavity 44.

In some embodiments, the method for tensioning the marine riser 12 can further include linking the flexible bladder 48 to the high pressure accumulator tank 54 to increase the total volume of gas in the hydraulic cylinder 14. In certain embodiments, the method for tensioning the marine riser 12 can further include lubricating the one or more dynamic seals 62 (e.g., as shown in FIG. 2B) between the piston 32 and the cylinder barrel 22. In some embodiments, the method for tensioning the marine riser 12 can further include preventing the gas 50 disposed within the flexible bladder 48 from contacting the one or more dynamic seals 62.

Although the technology herein has been described with reference to particular embodiments, it is to be understood that these embodiments are merely illustrative of the principles and applications of the present technology. It is therefore to be understood that numerous modifications can be made to the illustrative embodiments and that other arrangements can be devised without departing from the spirit and scope of the present technology as defined by the appended claims.

The invention claimed is:

1. A hydraulic cylinder for a marine riser, the hydraulic cylinder enclosing a cavity and containing a thru hole, an inner cylinder surface, and a longitudinal axis, comprising:
   - a piston disposed within the cavity and movable relative to the hydraulic cylinder in a direction parallel to the longitudinal axis between a first compressed position and a second extended position, the piston comprising:
     - a rod extending through the thru hole of the hydraulic cylinder;
     - the piston attached to the rod and in sealed engagement with the inner cylinder surface, the piston dividing the cavity in the hydraulic cylinder into a low pressure cavity, and a high pressure cavity containing the rod, each of the low and high pressure cavities containing a hydraulic fluid; and
   - a flexible bladder disposed within the high pressure cavity for containing a gas and preventing the gas from mixing with the hydraulic fluid in the high pressure cavity, the flexible bladder attached to an end of the hydraulic cylinder, and expandable within the high pressure cavity so that when the piston is in the first compressed position, the flexible bladder and the gas are compressed, and as the piston moves toward the second extended position, the flexible bladder and the gas fill at least a portion of the high pressure cavity.

2. The hydraulic cylinder of claim 1, further comprising:
   - a gas line extending from the flexible bladder to a high pressure external accumulator tank so that the flexible is in fluid communication with the external accumulator tank.

3. The hydraulic cylinder of claim 1, further comprising one or more dynamic seals between the piston and the inner cylinder surface, the seals being lubricated by the hydraulic fluid in the low pressure cavity and the high pressure cavity.

4. The hydraulic cylinder of claim 1, wherein the flexible bladder prevents the gas from contacting the one or more dynamic seals.

5. The hydraulic cylinder of claim 1, wherein the hydraulic fluid wets an interface between the piston and the inner cylinder surface.

6. The hydraulic cylinder of claim 1, wherein the flexible bladder comprises:

a plurality of gas bellow expansion joints, the gas bellow expansion joints providing a means to collapse the flexible bladder.

7. The hydraulic cylinder of claim 1, wherein the flexible bladder comprises an elastromeric material.

8. The hydraulic cylinder of claim 1, wherein the hydraulic cylinder comprises:

an end cap; and a cylinder head;

wherein the hydraulic cylinder is positioned between and attached to the end cap and the cylinder head.

9. The hydraulic cylinder of claim 1, wherein the flexible bladder is substantially filled with gas at full up stroke.

10. The hydraulic cylinder of claim 8, wherein the hydraulic cylinder is oriented so that the cylinder head is positioned above the end cap.

11. The hydraulic cylinder of claim 1, wherein the high pressure cavity contains the hydraulic fluid in an annular space defined by the inner barrel surface and the rod.

12. A flexible bladder for use in a hydraulic cylinder for a marine riser, the hydraulic cylinder including a cylinder barrel enclosing a cavity, and a piston disposed within the cavity, movable relative to the cylinder barrel, and dividing the cavity into a low pressure cavity and a high pressure cavity, each of the low and high pressure cavities containing a hydraulic fluid, the flexible bladder comprising:

a protective film positioned in the high pressure cavity, enclosing a gas, and preventing the gas from mixing with the hydraulic fluid in the high pressure cavity.

13. The flexible bladder of claim 12, further comprising:

a plurality of gas bellow expansion joints in the protective film to facilitate the collapse and expansion of the protective film.

14. The flexible bladder of claim 12, wherein the protective film is disposed between a rod and the cylinder barrel.

15. The flexible bladder of claim 12, wherein the protective film is a plurality of protective films disposed between a rod and the cylinder barrel.

16. The flexible bladder of claim 12, wherein the flexible barrel substantially fills the high pressure cavity.

17. A method of tensioning a marine riser using a hydraulic cylinder, the hydraulic cylinder including a cylinder barrel enclosing a cavity, and a piston disposed within the cavity, movable relative to the cylinder barrel, and the dividing the cavity into a low pressure cavity and a high pressure cavity, each of the low and high pressure cavities containing hydraulic fluid, the piston attached to a rod extending outside the cylinder barrel, the hydraulic cylinder further including a flexible bladder positioned in the high pressure cavity, enclosing a gas, and preventing the gas from mixing with the hydraulic fluid in the high pressure cavity, the method comprising:

attached the rod to a marine riser; and damping movement of the marine riser by compressing the gas within the flexible bladder as a tension force is applied to the piston rod so that the piston compresses the flexible bladder.

18. The method claim 17, further comprising the step of:

fluidly connecting the flexible bladder to a high pressure accumulator tank to increase the total volume of gas in the hydraulic cylinder.

19. The method of claim 17, further comprising the step of:

lubricating one or more dynamic seals between the piston and the cylinder barrel.

20. The method of claim 19, further comprising the step of:

preventing the gas disposed within the flexible bladder from containing the one or more dynamic seals.

* * * * *